US005411381A

United States Patent [19]

Perrodin

[11] Patent Number: 5,411,381

[45] Date of Patent: May 2, 1995

[54] RECIPROCATING PUMP

[76] Inventor: Philip E. Perrodin, 1030 D Delcambre Rd., Breaux Bridge, La. 70517

[21] Appl. No.: 207,073

[22] Filed: Mar. 8, 1994

[51] Int. Cl.[6] ..... F04B 45/033

[52] U.S. Cl. ..... 417/472; 417/555.1

[58] Field of Search ..... 417/547, 552, 569, 555.1, 417/545, 546, 548, 549, 472

[56] References Cited

U.S. PATENT DOCUMENTS

| | | | |
|---|---|---|---|
| 600,545 | 3/1898 | Mauldin | 417/552 |
| 1,266,974 | 5/1918 | Mitchell | 417/547 |
| 1,371,983 | 3/1921 | Scott | 417/472 |
| 1,546,973 | 7/1925 | Ellis | 417/472 |
| 2,245,501 | 6/1941 | Richardson | 417/547 |
| 2,814,992 | 12/1957 | Humason | 417/569 |
| 2,929,327 | 3/1960 | Coberly | 417/547 |
| 3,045,606 | 7/1962 | Schmidt | 417/569 |
| 3,164,102 | 1/1965 | Schmidt | 417/472 |
| 4,287,819 | 9/1981 | Emerit | 417/555.1 |
| 4,749,337 | 6/1988 | Dickinson | 417/199.1 |

FOREIGN PATENT DOCUMENTS

| | | | |
|---|---|---|---|
| 499351 | 1/1954 | Canada | 417/569 |

*Primary Examiner*—Richard A. Bertsch
*Assistant Examiner*—Peter Korytnyk
*Attorney, Agent, or Firm*—George A. Bode; Michael L. Hoelter

[57] ABSTRACT

A pump submersible in a well casing having fluid therein and comprising a reciprocating cylinder located within a pump housing and having a rod and piston which alternately draws the fluid into a sealed region of the pump housing through a one-way valve and then discharges this fluid from this sealed region through a one-way valve connected to discharge tubing. The sealed region of the pump housing can be defined by the end of the reciprocating piston or it can consist of a flexible bellows.

5 Claims, 4 Drawing Sheets

RECIPROCATING PUMP

BACKGROUND OF THE INVENTION

1. Field of the Invention

This invention pertains to a new design for pumping a liquid or a slurry or the like from a well and more particularly to a two-stage means of pumping wherein the pump is located within the well and is operated by a reciprocating cylinder that may be either pneumatically or hydraulically operated.

2. General Background

Pumps and devices utilizing a pumping action are used for a variety of different purposes. U.S. Pat. No. 868,192 issued to Vergne illustrates a hand-operated means of priming a main pump while U.S. Pat. No. 2,267,064 issued to Wikelund illustrates a hand-operated device for cleaning waste lines. U.S. Pat. No. 2,552,762 issued to Baker illustrates a more conventional hand pump that has been motorized and located within a pump house while U.S. Pat. No. 1,031,362 issued to Mohr discloses a pump that may be either hand-operated or power operated. U.S. Pat. No. 1,528,253 issued to Lanser illustrates a means of maintaining a certain liquid level for measuring pumps while U.S. Pat. No. 1,487,946 issued to Johnston incorporates a pair of cylinders to maintain the pumping action.

A different type of pump altogether is illustrated in U.S. Pat. No. 4,749,337 issued to Dickinson, et al., which discloses a first reciprocating (piston) pump for discharging water at a relatively high speed for purging purposes prior to sampling. The piston rod or tubing moves within the entire length of discharge tubing. Also, illustrated is a second bladder pump which operates at a relatively low speed for withdrawing actual water samples.

While each of these devices may be useful for their intended purpose, none of them pertain to the use of a pneumatic or hydraulic operated pump suspended within a well for discharge therefrom. It is thus an object of the present invention to provide such a novel means of removing water from deep within a well. Another object of the present invention is to provide a pump whose discharge tubing can either be located outside the pump housing but within the well casing or the discharge tubing can be enclosed within the pump housing. Another feature of the present invention is the capability of utilizing an enclosed bladder for temporarily containing the pumped fluid within the pump housing before it is delivered to the surface. Yet another object of the present invention is to provide a means of utilizing the reciprocating action of a pneumatic or hydraulic operated pump for both suction and discharge purposes. These and other features and objects of the present invention will become obvious upon further investigation.

SUMMARY OF THE PRESENT INVENTION

The preferred embodiment of the apparatus of the present invention solves the aforementioned problems in a straightforward and simple manner. What is provided is a pumping apparatus that incorporates a pump housing sized to be inserted within a well casing such that at least a lower region of this pump housing is submerged below the level of the fluid to be pumped. Additionally, a reciprocating cylinder is secured within the pump housing with this reciprocating cylinder alternately extending and retracting a member within the pump housing. Intake check valve means are secured to the lower region of the pump housing for permitting one-way flow into a sealed region of the pump housing. Discharge port means in fluid communication with this sealed region of the pump housing are used to discharge fluid from this sealed region. Additionally, discharge tubing is coupled to these discharge port means and extends to the surface. Exit check valve means secured to the discharge tubing permit one-way flow along the discharge tubing while control means are operated to control and operate the reciprocating cylinder whereby fluid is alternately drawn into the sealed region of the pump housing and discharged therefrom.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
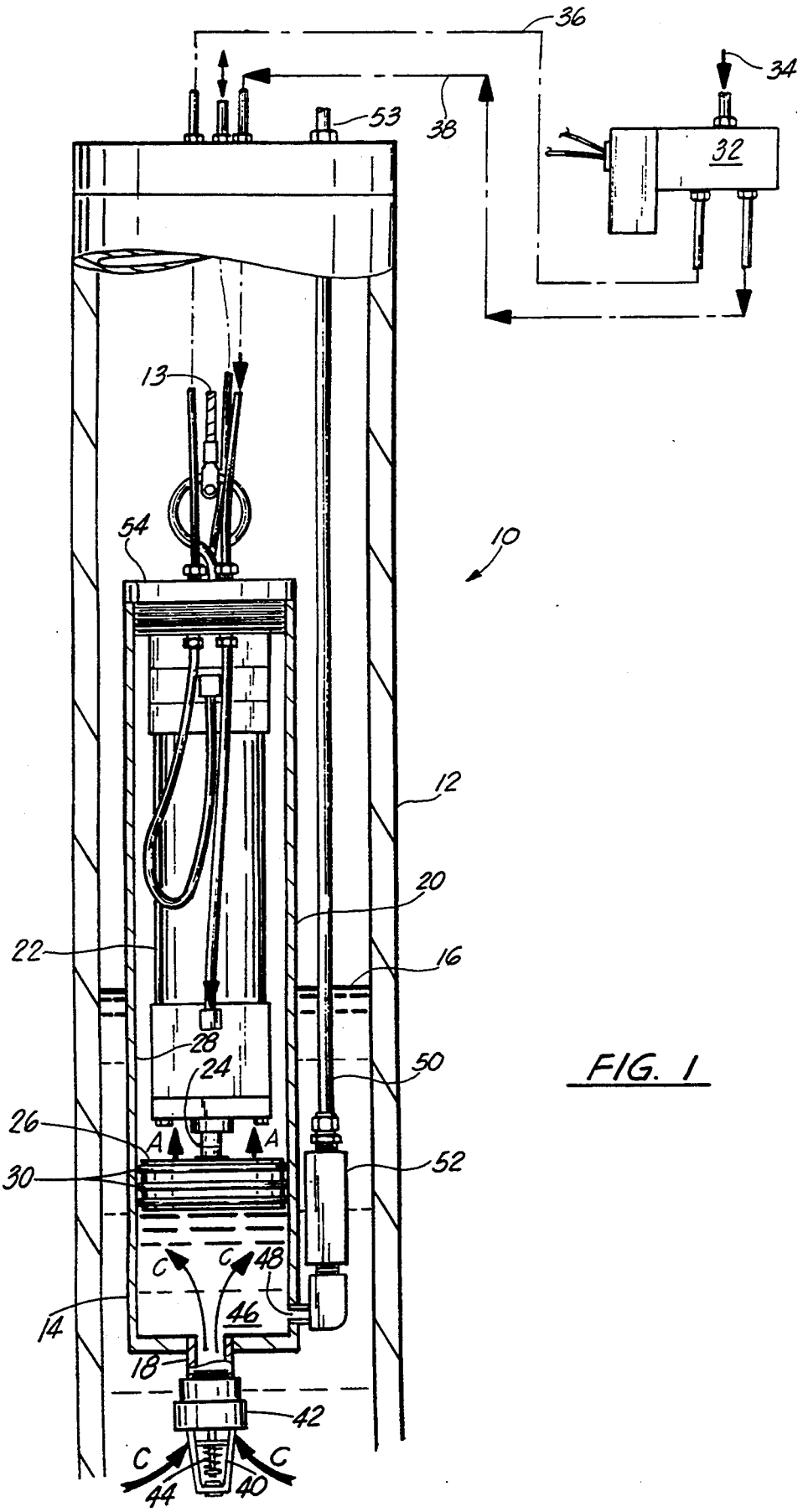
FIG. 1 is a pictorial side view, partially cut away, illustrating the preferred embodiment of the apparatus of the present invention during its upstroke or its intake stroke.
Figure 2:
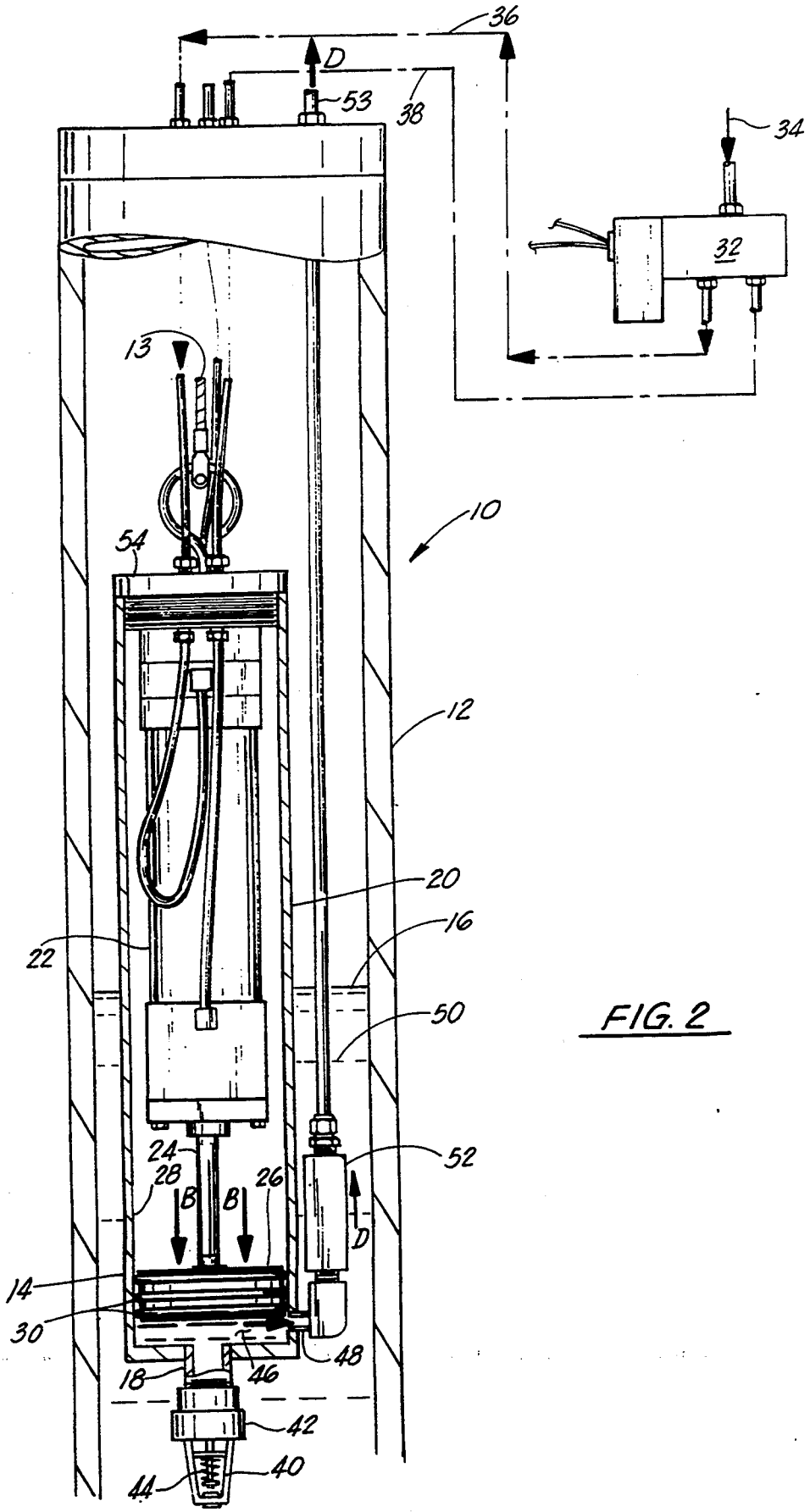
FIG. 2 is a pictorial side view, partially cut away, illustrating the embodiment of FIG. 1 during its down stroke or its discharge stroke.

Referring initially to FIGS. 1 and 2, there is shown the preferred embodiment of reciprocating pump assembly 10. This pump assembly 10, as shown, is suspended within well casing 12, such as by cable 13, with at least its lower region 14 submerged below the level of fluid 16 in the well casing 12. In some cases, it may be desirable to more fully submerge pump assembly 10, the important consideration being to at least submerge intake 18 below the level of fluid 16.

Pump assembly 10 includes pump housing 20 that encloses either a pneumatically or a hydraulically operated cylinder 22. In some cases, it is also possible for cylinder 22 to be electrically operated, but this would require carefully sealed fittings so as to avoid any occurrence of sparks and/or electrical shock.

Cylinder 22 incorporates elongated rod 24 having plunger or piston 26 secured to its outer or extending end region. Plunger 26 is sized so as to seal against the inner wall surface 28 of pump housing 20. A plurality of seals 30, such as O-rings, positioned around plunger 26, assure a water-tight seal between plunger or piston 26 and inner wall surface 28 of housing 20. During operation, as cylinder 22 is operated such as by control module 32, plunger 26 is alternately extended away from and moved towards cylinder 22. This occurs in the typical fashion by alternately supplying a pressurized medium 34 (either air or other fluid) and then releasing such pressure via lines 36 and 38 (compare FIG. 1 with FIG. 2, FIG. 3 with FIG. 4 and FIG. 5 with FIG. 6). Pump housing 20 is sized so as to provide sufficient room for the reciprocating extension and retraction of plunger 26.

Secured to lower region 14 of pump housing 20 is intake 18. Intake 18 consists of one or more openings or ports 40 in communication with fluid 16 and intake check valve assembly 42. Intake check valve assembly 42 may comprise a simple ball-type check valve or it may be spring activated 44 as shown. In any event, intake check valve assembly 42 permits fluid 16 to enter the interior of pump housing 20 during the intake or up-stroke (ARROWS A) of plunger 26 (FIG. 1). Intake check valve assembly 42 also blocks any leakage or escape of this fluid 16 from the interior of pump housing 20 during the discharge or down-stroke (ARROWS B) of plunger 26 (FIG. 2). Consequently, as cylinder 22 retracts rod 24 and plunger 26 (up-stroke of FIG. 1), sealed interior region 46 of pump housing 20 (between plunger 26 and intake 18) fills with fluid 16 (ARROWS C).

Connecting with sealed interior region 46 of housing 20 is discharge port 48. Discharge port 48, in the preferred embodiment of FIGS. 1 and 2, is located in an outer wall and lower region of pump housing 20 and is coupled to discharge tubing 50 located outside housing 20 but within well casing 12. Discharge tubing 50 includes discharge check valve assembly 52 which may also comprise a simple ball-type check valve (not shown) or it too may be spring activated (as assembly 42). In any event, discharge check valve assembly 52 permits fluid 16 to leave (ARROWS D of FIG. 2) sealed interior region 46 during the discharge or down-stroke of plunger 26 (FIG. 2) while preventing any such fluid 16 from entering sealed region 46 during the intake or upstroke of plunger 26. Generally, for the transportation of the largest volume of fluid 16, discharge port 48 would be located at the end of the down stroke of plunger 26.

Discharge tubing 50, as stated above, is shown in FIGS. 1 and 2 as being located outside pump housing 20 but within well casing 12. Such tubing 50 would then connect with a casing discharge fitting 53 and at its terminus a surface discharge port (not shown) for delivery of fluid 16 to the surface.

Figure 3:
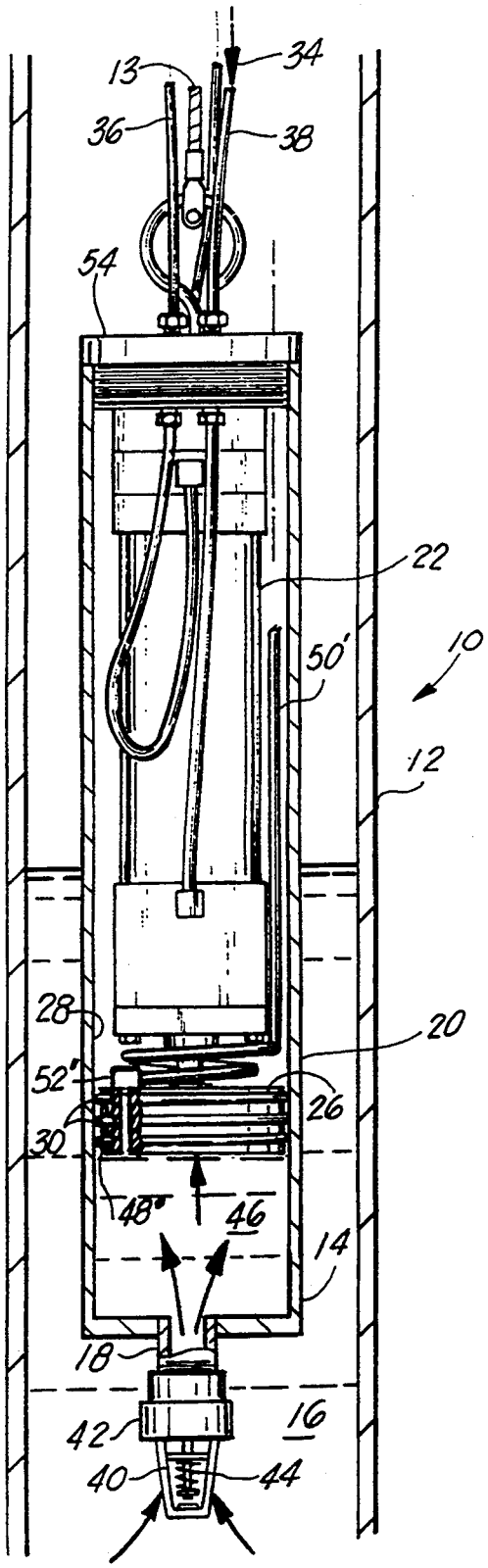
FIG. 3 is a pictorial side view, partially cut away, illustrating a second or alternate embodiment of the apparatus of the present invention during its upstroke or its intake stroke.
Figure 4:
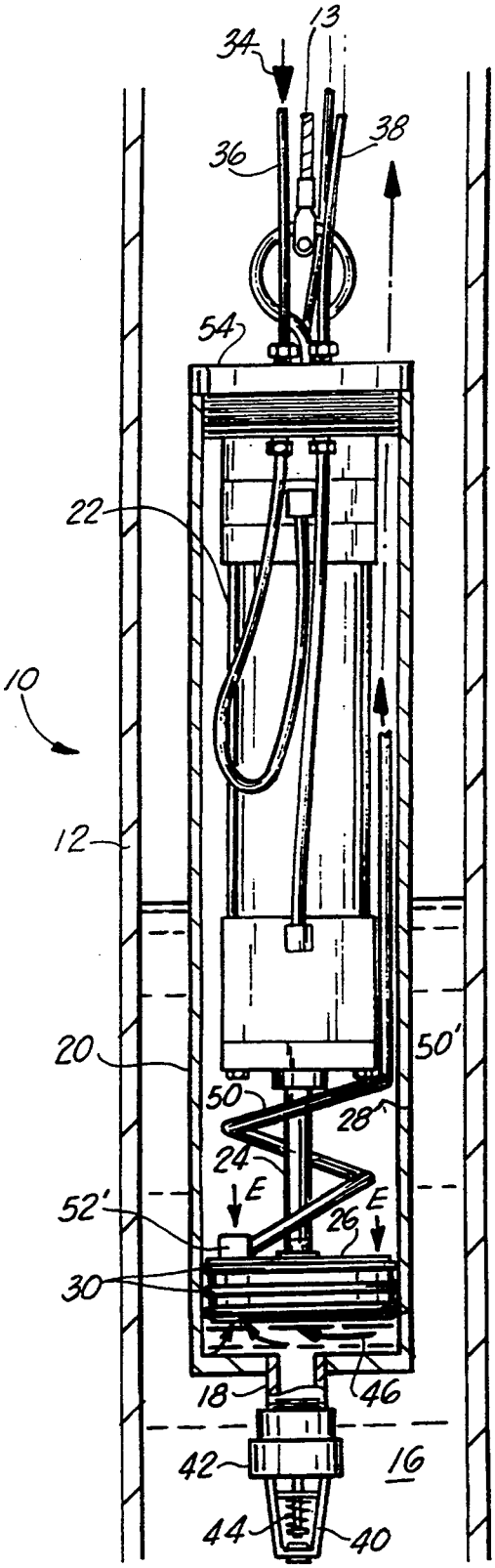
FIG. 4 is a pictorial side view, partially cut away, illustrating the embodiment of FIG. 3 during its downstroke or its discharge stroke.

In the alternate embodiment illustrated in FIGS. 3 and 4, flexible discharge tubing 50′ remains within pump housing 20 and exits such housing 20 from an upper region 54 thereof. In this fashion, there is no danger of damaging tubing 50′ by compressing it between housing 20 and well casing 12. Additionally, with this alternate embodiment, pump assembly 10 can be installed in smaller well casings 12 since the clearance required between pump housing 20 and well casing 12 is considerably less (i.e. no additional clearance is required for exterior discharge tubing 50′).

In the embodiment illustrated in FIGS. 3 and 4, discharge port 48′ passes through plunger 26 rather than through an outer wall of pump housing 20 as shown by port 48 in FIGS. 1 and 2. Additionally, discharge tubing 50′ is coiled around rod 24 of cylinder 22 so as to permit it to expand and/or contract as needed depending upon the extension of rod 24. This discharge tubing 50′ then extends upward along cylinder 22 within pump housing 20 till it exits housing 20 at upper region 54 thereof. Intermediate discharge tubing 50′ and plunger 26 in this embodiment is discharge check valve assembly 52′. By this arrangement, plunger 26 is able to extend nearly all the way to lower region 14 during its down-stroke (ARROWS E of FIG. 4) since there is no discharge port in the pump housing wall that must remain clear and accessible.

Figure 5:
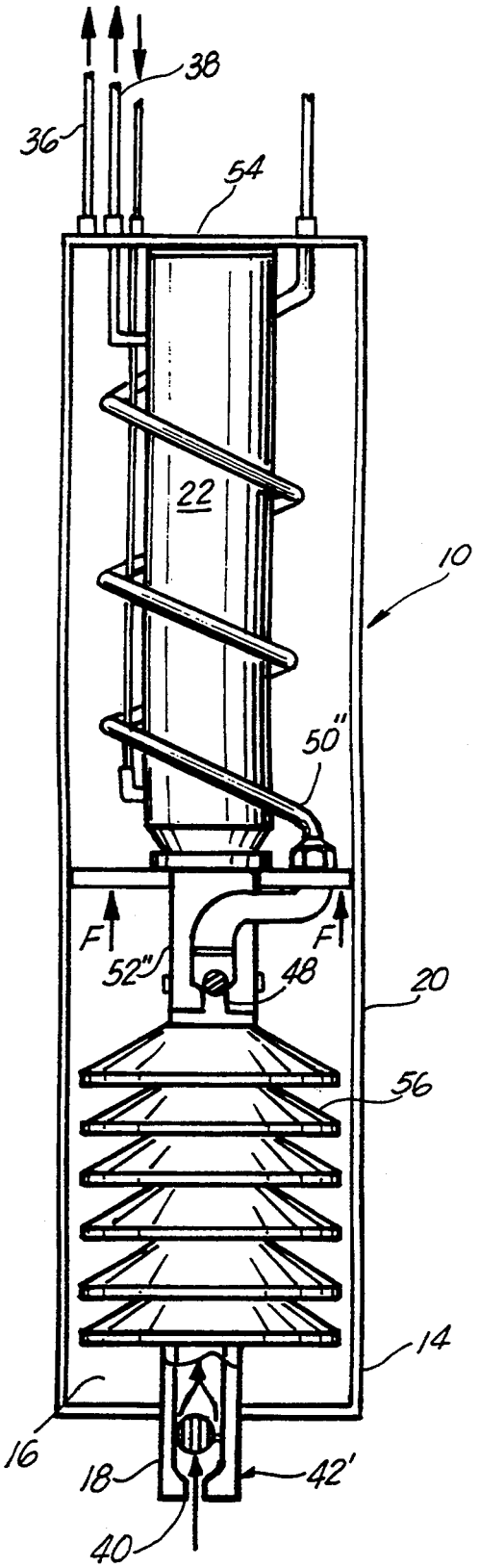
FIG. 5 is a pictorial side view, partially cut away, illustrating a third or another alternate embodiment of the apparatus of the present invention during its upstroke or its intake stroke; and, FIG. 6 is a pictorial side view, partially cut away, illustrating the embodiment of FIG. 5 during its downstroke or its discharge stroke.
Figure 6:
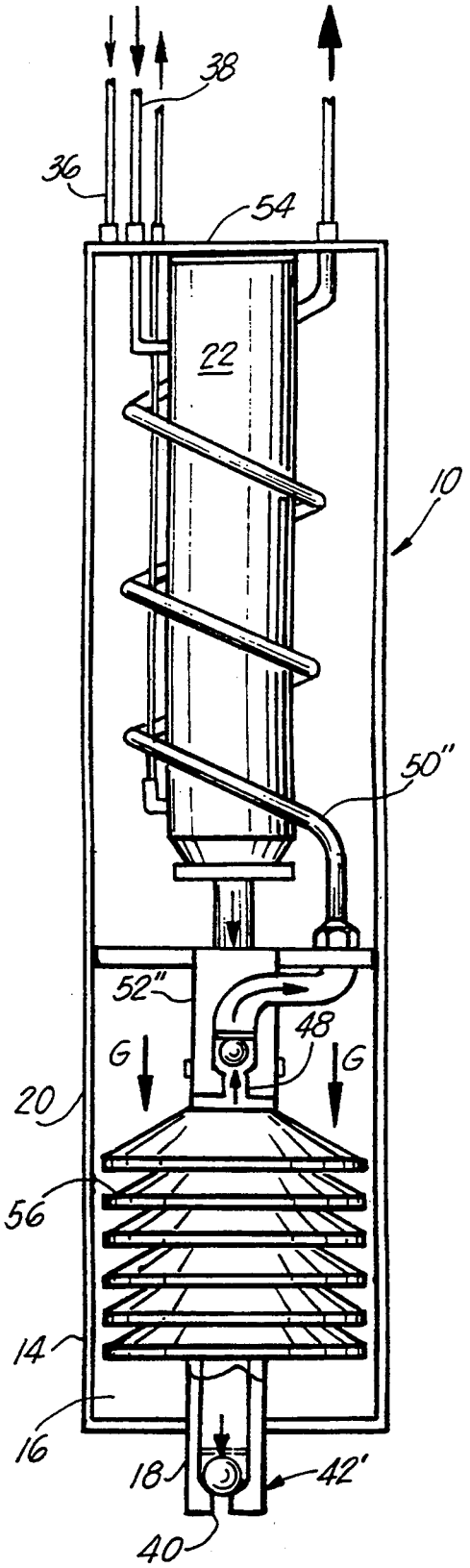

Referring now to FIGS. 5 and 6, another alternate embodiment of pump assembly 10 is illustrated. In this embodiment, discharge tubing 50″ is located within pump housing 20 and may be coiled around cylinder 22 as shown Additionally, a flexible unitary bellows 56 is secured intermediate discharge tubing 50″ and intake check valve assembly 42′. This bellows 56 receives the incoming fluid from intake check valve assembly 42′ and discharges it to discharge tubing 50″. Bellows 56 is alternately moved from an intake position (extended as in FIG. 5) to a discharge position (compressed as in FIG. 6) by the operation of cylinder 22. Such movement (ARROWS F of FIG. 5 and ARROWS G of FIG. 6) of bellows 56 causes fluid 16 to be pumped from within the well, through intake check valve assembly 42′, into bellows 56, through discharge check valve assembly 52″, into discharge tubing 50″, and up to the surface. By incorporating bellows 56, fluid 16 remains contained within bellows 56 of pump housing 20 as desired so that any abrasive or the like do not score or otherwise shorten the life of pump assembly 10. Bellows 56 may be constructed of any water-tight or liquid-tight material such as rubber, nylon, plastic or the like and can be easily replaced should such be required.

During operation of pump assembly 10, control module 32 is activated, thereby causing medium 34 (which may be either hydraulic fluid or air) to pressurize lines 36 and 38. Upon such pressurization of cylinder 22, rod 24 is either extended or retracted in the normal fashion, thereby either extending or retracting plunger or piston 26. As plunger 26 moves, its seal 30 with inner wall surface 28 of housing 20 causes fluid 16 to either be drawn up within sealed region 46 of housing 20 or be discharged from this sealed region 46 via discharge tubing 50. Both intake and discharge check valve assemblies 42 and 52 prevent any backflow of fluid 16 through pump assembly 10 from occurring.

By altering the configuration of discharge tubing 50 such that is remains within housing 20 as illustrated by 50′ and 50″ in FIGS. 3–6, less damage to well casing 12 is likely and pump assembly 10 can be installed within smaller wells. Additionally, by incorporating bellows 56 as shown in the embodiment of FIGS. 5 and 6, the fluid pumped by pump assembly 10 remains confined within bellows 56 of pump housing 20, thereby reducing the opportunity of scoring or otherwise causing damage to the interior of pump housing 20.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A pumping apparatus for a well comprising:

(a) a sealed pump housing adapted to be suspended within a well casing wherein at least a lower region of said pump housing is submerged below the level of the fluid to be pumped from said well;

(b) movable cylinder means secured within said pump housing, said movable cylinder means being operatively connected to flexible bellows means for containing said fluid pump from said wall to within said pumping house;

(c) intake valve means secured to said lower region of said pump housing for permitting one-way fluid flow into said bellow means;

(d) discharge port in fluid communication with said bellow means for permitting discharge of said fluid from said bellows means;

(e) discharge tubing coupled to said discharge port and extending helically upwardly within said pump housing before exiting an upper region of said pump housing and piercing the upper region of said well casing;

(f) exit valve means provided in said discharge tubing for permitting one-way flow along said discharge tubing; and, (g) control means for activating said movable cylinder means, whereby fluid in said well casing is alternately drawn into said bellows means via said intake valve means and discharged therefrom through said discharge port and tubing.

2. The apparatus as set forth in claim 1 wherein said intake check valve means comprises a spring biasing a ball to the closed position against a valve seat.

3. The apparatus as set forth in claim 1 wherein said pump housing is helically upward suspended within said well casing.

4. The apparatus as set forth in claim 3 wherein said discharge tubing extends vertically within said pump housing and exits an upper region of said pump housing before piercing the upper region of said well casing.

5. The apparatus as set forth in claim 4 wherein said exit valve means is provided in said discharge tubing interiorly of said pump housing and comprises a ball normally biased to the closed position against a valve seat.

* * * * *